US012516844B1

(12) United States Patent
Day Chief

(10) Patent No.: US 12,516,844 B1
(45) Date of Patent: Jan. 6, 2026

(54) VENT MOUSE GUARD

(71) Applicant: Dale Day Chief, Lethbridge (CA)

(72) Inventor: Dale Day Chief, Lethbridge (CA)

( * ) Notice: Subject to any disclaimer, the term of this patent is extended or adjusted under 35 U.S.C. 154(b) by 358 days.

(21) Appl. No.: 18/197,581

(22) Filed: May 15, 2023

(51) Int. Cl.
*F24F 13/08* (2006.01)

(52) U.S. Cl.
CPC ..... *F24F 13/084* (2013.01)

(58) Field of Classification Search
CPC ..... F24F 13/06; F24F 13/082; F24F 13/084
See application file for complete search history.

(56) References Cited

U.S. PATENT DOCUMENTS 770,326 A * 9/1904 Slater ..... F24F 13/06 454/290
5,720,660 A 2/1998 Benedetto et al.
7,909,686 B2 3/2011 Achen
8,216,034 B1 * 7/2012 Sona ..... F24F 13/085 454/289
2023/0366585 A1 * 11/2023 Carroll ..... F24F 13/06

* cited by examiner

*Primary Examiner* — Allen R. B. Schult
(74) *Attorney, Agent, or Firm* — Sanchelima & Associates, P.A.; Jesus Sanchelima; Christian Sanchelima

(57) ABSTRACT

A vent mouse guard including a frame assembly and a grate assembly. The frame assembly includes a frame integrally formed with a screen, wherein the screen has a plurality of openings that allows air from the air vent system of the house to flow through thereof and prevents the egress and/or ingress of pests such as rodents. The frame includes a peripheral wall that covers the opening of the air vent system allowing the floor vent register to be mounted as usual, thereby the present invention may be mounted between any vent of the air vent system of the floor, wall and/or ceiling and the vent register respectively.

3 Claims, 3 Drawing Sheets

VENT MOUSE GUARD

II. BACKGROUND OF THE INVENTION

1. Field of the Invention

The present invention relates to a mouse guard and, more particularly, to a vent mouse guard that is mounted on the ventilation system opening and underneath a floor vent register to prevent pests from leaving the ventilation system to rooms in a home.

2. Description of the Related Art

Several designs for pest barriers for floor vents have been designed in the past. None of them, however, include a frame assembly capable of being inserted between a floor vent register and the floor vent of a home, wherein the frame assembly includes a screen to prevent ingress or egress of rodents.

Applicant believes that a related reference corresponds to U.S. Pat. No. 7,909,686 issued for flood and combustion air vent. Applicant believes that another related reference corresponds to U.S. Pat. No. 5,720,660 issued for protective cover for a heat register. None of these references, however, teach of a grate or screen which is inserted into the frame of a floor vent or register to prevent ingress or egress of rodents or other pests from the HVAC system to rooms in a home.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide an improved way to prevent mice and other rodents from nesting and traveling through HVAC floor/wall vents.

It is another object of this invention to force mice to retreat back to the main furnace area for easy trapping and disposal, preventing exposure to toxic mouse droppings.

It is still another object of the present invention to provide added protection and peace of mind.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 3:
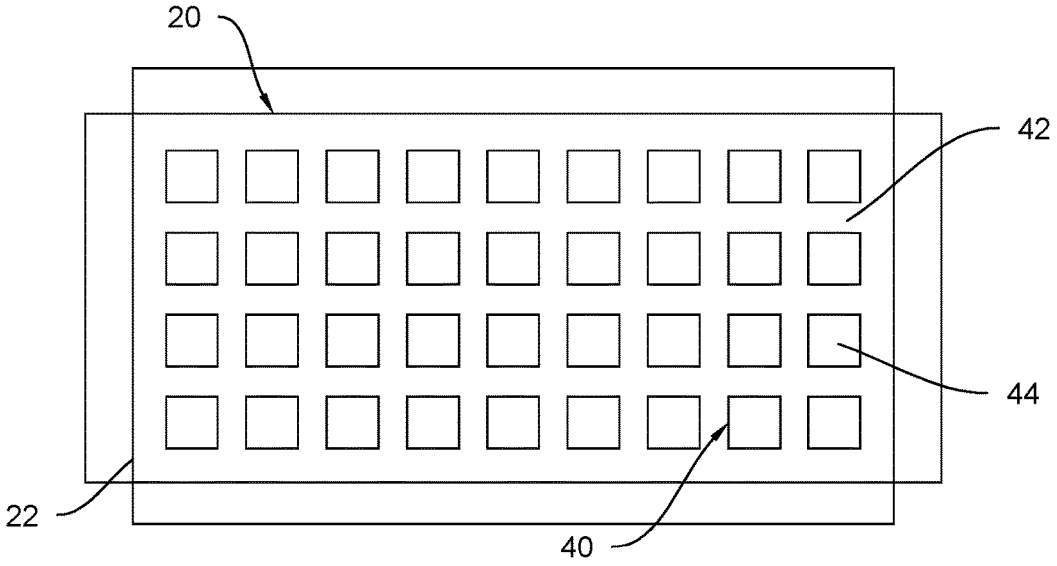

FIG. 3 illustrates a top view of the grate assembly 40 illustrating the screen 42 with the screen spacing 44.

Figure 4:
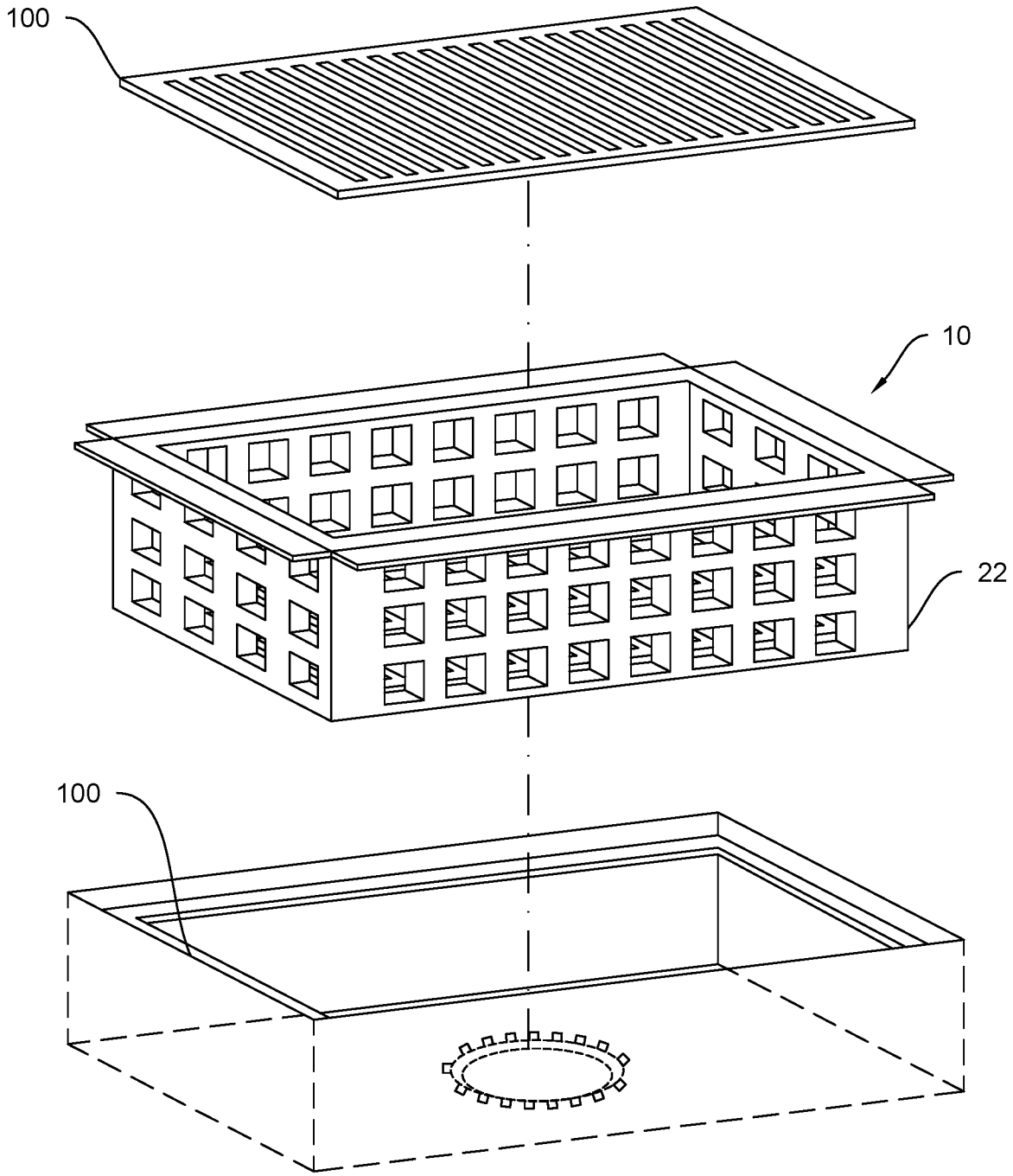

FIG. 4 is a representation of an exploded view of the installation between the floor vent 100, the present invention 10, and the floor vent register 101.

V. DETAILED DESCRIPTION OF THE EMBODIMENTS OF THE INVENTION

Referring now to the drawings, where the present invention is generally referred to with numeral 10, it can be observed that it basically includes a frame assembly 20 and a grate assembly 40, flap assembly 60 and various exemplary embodiments (100, 101) thereof. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 1:
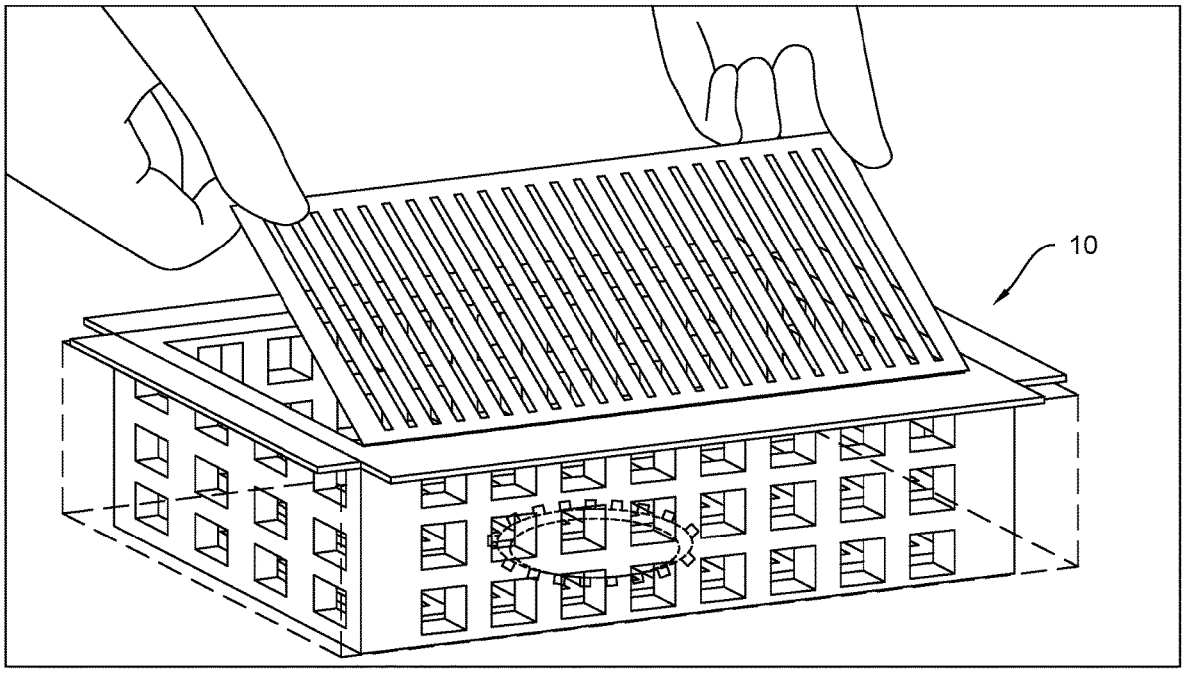
FIG. 1 represents an operational view of an exemplary embodiment of the present invention 10 which is placed at the bottom of a floor vent 100.
Figure 2:
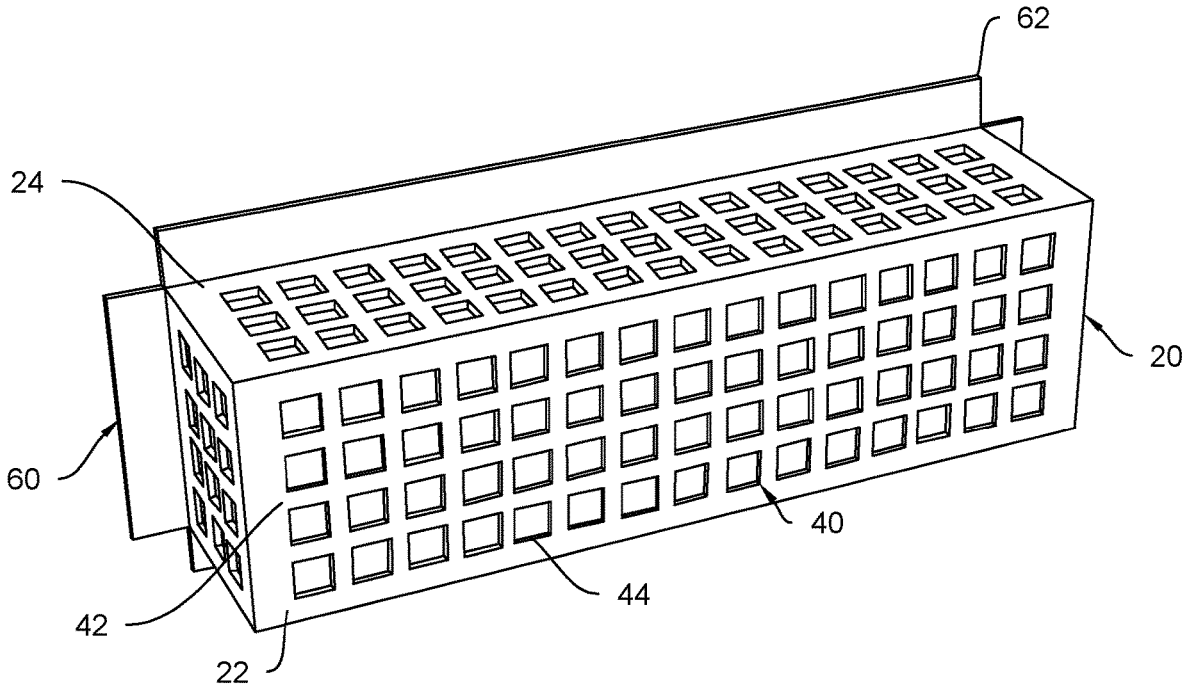
FIG. 2 shows an isometric view of the frame assembly 20 including the grate assembly 40.

Frame assembly 20 includes a frame 22 and a peripheral wall 24. In an exemplary embodiment, the frame 22 may be a rigid support that covers an opening of the air system of a home floor vent 100. It should be considered that the vent 100 is an opening located on the floor, ceiling or walls that supply heated or cooled air into the room. As FIG. 1 illustrates. In a suitable embodiment, the frame 22 may be placed at the bottom of floor vent 100, wherein the bottom face of the frame 22 may be abutting against the bottom side of the floor vent 100 in its various locations such as the wall or ceiling. In a suitable variation, the frame 22 may be secured at the bottom side of the floor vent 100 by means of fasteners, wherein the frame 22 may include openings adapted to receive said fasteners. In one embodiment, the frame 22 may be made of steel, alloy steel, hard plastic, aluminum or any other suitable material to support temperature changes caused by the vent system of the house, wherein a hard and heavy material me also be considered for the frame 22 to prevent from being lifted by means of a pest such as rodents. In a preferred embodiment, frame 22 includes the peripheral wall 24 integrally formed at the periphery thereof, wherein the peripheral wall 24 may be walls perpendicularly along the periphery edges of the frame. As FIG. 2 represents. The peripheral wall 24 may settle on the air vent system of the floor vent 100, thereby the frame assembly is held in place between the floor vent 100 and the floor vent register 101. As best depicted in FIG. 4.

Grate assembly 40 includes a screen 42 and a screen spacing 44. In an exemplary embodiment, the screen 42 may be integrally formed with the frame 22, wherein the screen 42 comprises a series of parallel longitudinal members and cross longitudinal members integrally formed therebetween, wherein the parallel and cross longitudinal members may be accurate spacing formed, thus said separation therebetween defines the screen spacing 44 or plurality of openings. In a suitable embodiment, the plurality of openings is separated therebetween by means of the screen spacing 44, as FIG. 3 depicts, thereby the screen 42 may allow air to flow from the air vent system to the rooms inside the house, nevertheless the screen spacing 44 may allow pests such as rodents from egress from the air vent system of the house to the rooms and may prevent the pests from ingress to the air vent system. It should be considered that the screen 42 may be made of a strong material that prevents it from being damaged due to scratches or bites from said pest. In a preferred embodiment, the plurality of opening of the screen 42 may be a squared shaped grid, as FIG. 3 illustrates, nevertheless the plurality of openings may have a circular shape, a square shape, a regular or irregular shape, or any other suitable shape to allow air to flow through thereof and prevent pests from crossing the screen. In a suitable variation, the screen 42 may be a welded wire mesh attached to the frame 22.

Flap assembly 60 including flaps 22, wherein the flaps 62 are perpendicular extended portions of the peripheral wall 24. As FIG. 2 depicts. It should be considered that the flaps 62 are integrally formed with the peripheral wall, nevertheless the flaps 62 may be attached at the peripheral wall. In a suitable embodiment, the flaps 62 may conform with the edges of the floor vent register 101, thereby the present invention when installed in the floor vent or wall vent 100 may be secured by means of the coupling between the floor vent or wall vent 100 and the floor vent register 101. As FIG. 4 represents. In a preferred embodiment, flaps 62 may include openings parallel located with respect to the openings of the floor vent register 101, thus the frame assembly 20 may be secured in place by means of the fasteners that fix the floor vent register to the floor vent or wall vent 100.

Referring to the figures and more specifically to FIG. 1, the present invention 10 may be placed inside the floor vent or wall vent 100, wherein the flaps 62 abuts against the floor vent or wall vent 100 providing a device removably attachable to any air vent of the air vent system of the house to prevent ingress or egress of pests.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A vent mouse guard, comprising:

a) a frame assembly including a bottom portion having a rectangular shape, and a plurality of side walls extending upwardly from sides of the bottom portion; wherein said bottom portion and said plurality of side walls are formed as a grid structure defined by a multiplicity of substantially squared openings arranged in a matrix arrangement; wherein said frame assembly has an open top; wherein the vent mouse guard includes a peripheral flange extending outwardly from a periphery of said open top, wherein said peripheral flange extends perpendicularly relative to each of said plurality of side walls.

2. The vent mouse guard of claim 1, wherein said bottom portion abuts against a top surface of a floor or wall vent.

3. A vent mouse guard, consisting of:

a) a frame assembly including a bottom portion having a rectangular shape, and a plurality of side walls extending upwardly from sides of the bottom portion; wherein said bottom portion abuts against a top surface of a vent; wherein said bottom portion and said plurality of side walls are formed as a grid structure defined by a multiplicity of squared openings arranged in a matrix arrangement; wherein said frame assembly has an open top; wherein the vent mouse guard includes a peripheral flange extending outwardly from a periphery of said open top, wherein said peripheral flange extends perpendicularly relative to each of said plurality of side walls, wherein said peripheral flange is defined by four rectangular flaps, wherein each rectangular flap is connected to a corresponding side wall;

b) wherein a removable cover is positioned over the open top when said vent mouse guard is placed over the top surface of the vent; said removable cover has a shape that contours to the periphery of the open top; wherein said removable cover is circumscribed within the peripheral flange when placed over the open top.

* * * * *